US008596773B2

(12) United States Patent
Hanagami

(10) Patent No.: US 8,596,773 B2
(45) Date of Patent: Dec. 3, 2013

(54) LIQUID EJECTION APPARATUS

(75) Inventor: Taiki Hanagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/604,268

(22) Filed: Sep. 5, 2012

(65) Prior Publication Data

US 2013/0057623 A1 Mar. 7, 2013

(30) Foreign Application Priority Data

Sep. 6, 2011 (JP) ..... 2011-193597

(51) Int. Cl.
*B41J 2/19* (2006.01)

(52) U.S. Cl.
USPC ..... 347/92

(58) Field of Classification Search
USPC ..... 347/85, 92, 93, 94
See application file for complete search history.

(56) References Cited

U.S. PATENT DOCUMENTS

| | | | | |
|---|---|---|---|---|
| 5,777,649 | A * | 7/1998 | Otsuka et al. | 347/94 |
| 5,808,643 | A * | 9/1998 | Tracy et al. | 347/92 |
| 6,007,193 | A * | 12/1999 | Kashimura et al. | 347/92 |
| 6,457,820 | B1 * | 10/2002 | Cai et al. | 347/92 |
| 6,976,754 | B2 * | 12/2005 | Ohashi et al. | 347/92 |
| 7,014,303 | B2 * | 3/2006 | Matsushita et al. | 347/85 |
| 2009/0079773 | A1 | 3/2009 | Hosono et al. | |

FOREIGN PATENT DOCUMENTS

| | | |
|---|---|---|
| JP | 2000-103084 | 4/2000 |
| JP | 2009-073074 | 4/2009 |

* cited by examiner

*Primary Examiner* — Anh T. N. Vo
(74) *Attorney, Agent, or Firm* — Workman Nydegger

(57) ABSTRACT

A printer includes a filter unit having a distribution flow path through which the introduced ink flows into a recording head, and an air bubble trap in which air bubbles which have entered ink in the distribution flow path are collected, the air bubble trap being provided with a waterproof member having a waterproof property and an air permeability that forms part of a wall of the air bubble trap. A printer includes an air bubble suction mechanism that suctions air bubbles collected in the air bubble trap through the waterproof member.

7 Claims, 8 Drawing Sheets

LIQUID EJECTION APPARATUS

BACKGROUND

1. Technical Field

The present invention relates to a liquid ejection apparatus having a liquid ejection head that ejects a liquid.

2. Related Art

As an example of liquid ejection apparatus, ink jet printers having a recording head, which is an example of a liquid ejection head, are well known. In the ink jet printers, ink is supplied from a liquid containing chamber such as an ink cartridge to a recording head via a flow path formed in a flow path forming member. Once supplied to the recording head, ink is stored in a reservoir, and then supplied from the reservoir to pressure generating chambers. When pressure generating elements such as piezoelectric elements apply pressure change to ink in the pressure generating chambers, ink is ejected through nozzles that communicate with the pressure generating chambers.

In such an ink jet printer, if air bubbles are present in the flow path due to air bubbles previously contained in ink which is introduced from the liquid containing chamber, or growing of air bubbles in the flow path in the flow path forming member or the recording head, air bubbles obstruct the flow of ink and may cause a failure of proper ejection of ink, which may result in a poor printing quality. Further, if air bubbles enters ink in the pressure generating chambers of the recording head, air bubbles absorb the pressure change generated by the pressure generating elements, which may cause ejection properties such as the amount of ejected ink or the ejection rate of ink to be lowered.

JP-A-2009-73074 discloses a technique to remove air bubbles in a flow path in a flow path forming member or a recording head of an ink jet printer, including a flushing operation in which air bubbles in the flow path are discharged through nozzles along with ink by driving pressure generating elements, and an ink suction operation in which a nozzle surface of the recording head is covered with a cap and air bubbles are forcibly suctioned through the cap along with ink by using a pump.

Further, JP-A-2000-103084 discloses a recording apparatus which includes an air bubble trap disposed on the outside of an arrangement direction of a plurality of ejection channels that connect circulation flow paths and a recording head. In this configuration, while ink from an ink tank circulates in the circulation flow paths, air bubbles which have entered ink is collected in the air bubble trap so as to prevent air bubbles from entering the recording head through ejection channels. In this recording apparatus, air bubbles collected in the air bubble trap move upward into an ink outlet port formed on the upper side of the air bubble trap due to buoyancy of air bubbles themselves, and are recovered into the ink tank through the ink outlet port.

However, the flushing or the ink suction operation has a problem that ink is also discharged with air bubbles, which causes a large amount of ink to be consumed during removing of air bubbles.

Moreover, according to the technique described in JP-A-2000-103084, air bubbles collected in the air bubble trap are discharged by using buoyancy of air bubbles themselves.

Since air bubbles are not actively discharged, air bubbles may not be sufficiently discharged.

SUMMARY

An advantage of some aspects of the invention is that a solution for at least part of the above-mentioned problems that can be achieved in the following embodiment or application examples is provided.

Application Example 1

A liquid ejection apparatus includes a liquid ejection head that ejects a liquid; a flow path forming member having a distribution flow path through which the introduced liquid flows into the liquid ejection head, the flow path forming member including an air bubble trap in which air bubbles which have entered the liquid in the distribution flow path are collected, and a waterproof member having a waterproof property and an air permeability that forms part of a wall of the air bubble trap; and a suction unit that suctions air bubbles in the air bubble trap through the waterproof member.

With this configuration, air bubbles which have entered the liquid flowing through the distribution flow path of the liquid ejection head are collected in the air bubble trap, and then discharged from the air bubble trap through the waterproof member having an air permeability by using a suction of the suction unit. On the other hand, the liquid in the distribution flow path does not tend to pass through the waterproof member having a waterproof property. Accordingly, air bubbles can be discharged while preventing the liquid from being discharged with air bubbles. Therefore, it is possible to discharge air bubbles from the inside of the liquid ejection head while reducing consumption of the liquid.

Application Example 2

The liquid ejection apparatus according to the above application example, wherein the distribution flow path has an expanded flow path that expands in the vertical direction, and a vertically upper portion of the expanded flow path serves as the air bubble trap.

With this configuration, since the vertically upper portion of the expanded flow path of the distribution flow path serves as the air bubble trap, air bubbles which have entered the liquid flowing through the distribution flow path move upward and are collected into the air bubble trap due to the buoyancy, and then discharged through the waterproof member. Therefore, it is possible to effectively discharge air bubbles which have entered the liquid in the distribution flow path.

Application Example 3

The liquid ejection apparatus according to the above application examples, further comprising a filter that is disposed in the distribution flow path of the flow path forming member, wherein the air bubble trap is located vertically above the filter.

With this configuration, air bubbles which are blocked by the filter and collected in an upstream area of the filter move upward due to the buoyancy and are collected in the air bubble trap, and then discharged though the waterproof member. Therefore, it is possible to effectively discharge air bubbles which have been collected in the upstream area of the filter.

Application Example 4

The liquid ejection apparatus according to the above application examples, wherein the flow path forming member further includes a second air bubble trap in which air bubbles which have entered the introduced liquid are collected, and a second waterproof member having a waterproof property and an air permeability that forms part of a wall of the second air bubble trap, and wherein the suction unit includes a first suction path that extends on a side of the waterproof member which is opposite to the air bubble trap, a second suction path that extends on a side of the second waterproof member which is opposite to the second air bubble trap, a merge path that merges the first suction path and the second suction path, and a pump member that suctions air bubbles via the merge path.

With this configuration, since air bubbles in the air bubble trap and the second air bubble trap are discharged by suctioning air bubbles from the merge path, air bubbles can be discharged from the air bubble trap and the second air bubble trap with a simple configuration compared with a configuration in which air bubbles are separately suctioned from both air bubble traps.

Application Example 5

The liquid ejection apparatus according to the above application examples, further comprising a moving mechanism that moves the liquid ejection head, wherein the suction unit includes a pump member that is configured to expand and contract so as to suction air bubbles through the waterproof member, and an abut member that is disposed at a position capable of abutting against the pump member when the liquid ejection head moves, and wherein the moving mechanism moves the pump member with the liquid ejection head in directions away from and toward the abut member so as to expand and contract the pump member.

With this configuration, air bubbles can be suctioned with a simple configuration in which the moving mechanism that moves the liquid ejection head expands and contracts the pump member.

Application Example 6

The liquid ejection apparatus according to the above application examples, wherein the suction unit includes an inlet path that connects a side of the waterproof member which is opposite to the air bubble trap and an inside of the pump member, an atmosphere opening path that opens the inside of the pump member to the atmosphere, a first check valve that controls a flow out of the pump member via the inlet path, and a second check valve that controls a flow into the pump member via the atmosphere opening path.

With this configuration, when the pump member is expanded or contracted by the second check valve, the pressure inside the pump member can be effectively depressurized, air bubbles in the air bubble trap can be effectively suctioned by the first check valve. Accordingly, it is possible to effectively discharge air bubbles in the air bubble trap by expanding and contracting the pump member.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the drawings. In this embodiment, a printer having an ink jet recording head will be described as an example of liquid ejection apparatus having a liquid ejection head.

Figure 1:
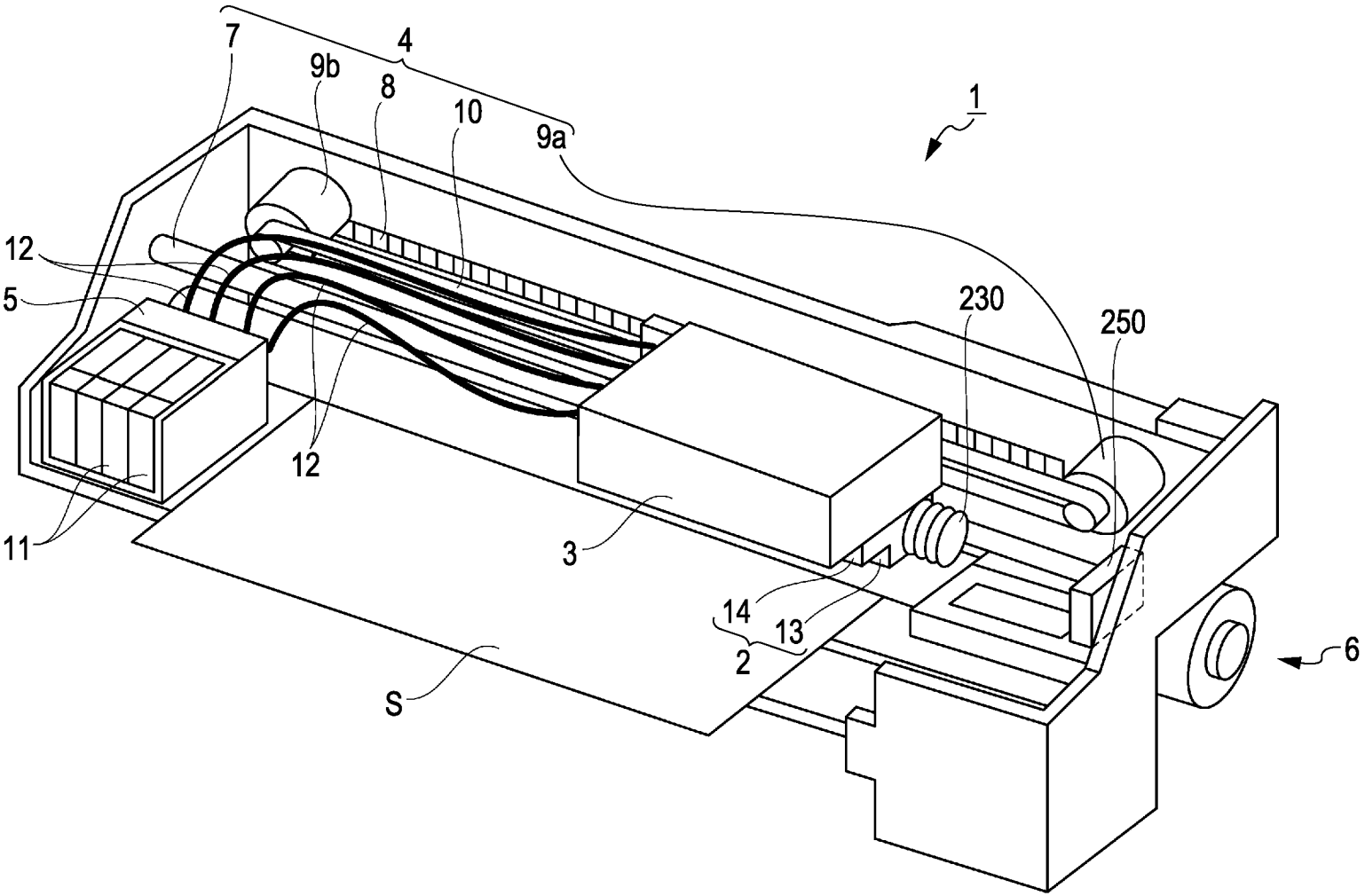
FIG. 1 is a view which shows a schematic configuration of a printer according to an embodiment of the invention.

FIG. 1 is a view which shows a schematic configuration of a printer. As shown in FIG. 1, a printer 1 includes a carriage 3 on which an ink jet recording head unit 2 is mounted, a carriage moving mechanism (moving mechanism) 4 that reciprocates the carriage 3 in a paper width direction of a recording paper S, which is an ejection target medium, a cartridge housing 5, and a sheet feeding mechanism 6 that feeds the recording paper S. A direction in which the carriage 3 moves with respect to the recording paper S is defined as a main scan direction and a direction in which the recording paper S is fed is defined as a sub-scan direction, which is perpendicular to the main scan direction.

The carriage moving mechanism 4 includes a guide rod 7 that extends in the main scan direction, a linear scale 8 of a linear encoder disposed in the main scan direction, a timing belt 10 that extends around a driving roller 9*a* that receives a drive power from a carriage motor and a driven roller 9*b*. The carriage 3 is slidably mounted on the guide rod 7, and a portion of the carriage 3 is engaged with the timing belt 10. Accordingly, when the carriage motor actuates, the recording head unit 2 mounted on the carriage 3 moves along the guide rod 7. The position of the carriage 3 in the main scan direction is detected by a linear encoder which is disposed on the carriage 3 on the side of the linear scale 8 and reads the linear scale 8. The linear encoder sends detection signals to control means, which is a print controller (not shown). Based on those detection signals, the print controller recognizes the position of the carriage 3, that is, the position of the recording head unit 2 within a scanning area and controls a recording operation of the recording head unit 2.

The cartridge housing 5 is provided at an end of the moving range of the carriage 3 and ink cartridges 11 are loaded therein. The cartridge housing 5 and the recording head unit 2 mounted on the carriage 3 are connected via ink supply tubes 12 so that ink is supplied from the ink cartridges 11 which is loaded in the cartridge housing 5 to the recording head unit 2 via ink supply tubes 12. That is, the printer 1 of this embodiment is of an off-carriage type in which ink cartridges 11 are loaded outside of the carriage 3. Although this embodiment is described as having four ink cartridges 11 that correspond to cyan ink, magenta ink, yellow ink, and black ink which are detachably mounted in the cartridge housing 5, the type of ink and the number of ink cartridges 11 are not limited thereto.

Next, a configuration of the recording head unit 2 will be described. The recording head unit 2 includes a recording head 13 that ejects ink onto the recording paper S and a filter unit (flow path forming member) 14 that supplies ink which is introduced from each ink cartridge 11 to the recording head 13 via a filter disposed inside the filter unit 14.

Figure 2:
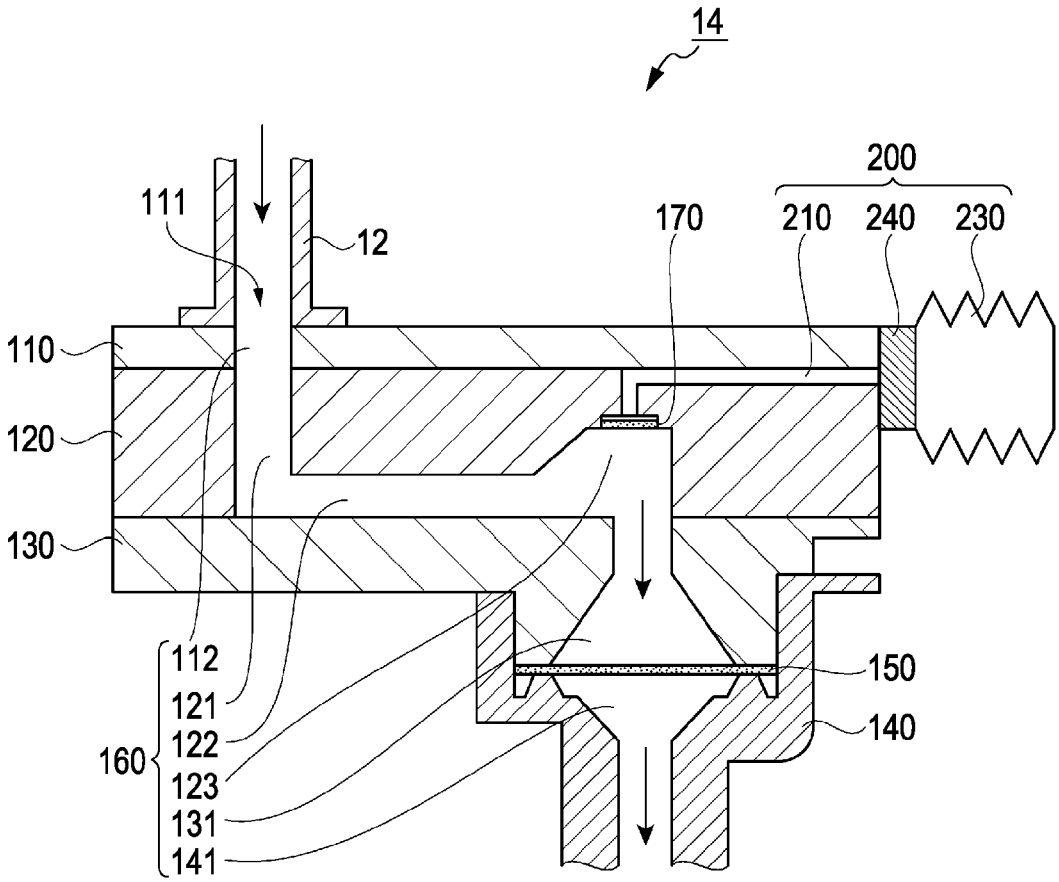
FIG. 2 is a sectional view which shows a configuration of a filter unit.

FIG. 2 is a sectional view which shows a configuration of the filter unit 14. As shown in FIG. 2, the filter unit 14 includes a first flow path forming member 110 that is connected to the ink supply tube 12, a second flow path forming member 120 that is bonded on the first flow path forming member 110, a third flow path forming member 130 that is bonded on the second flow path forming member 120, and a fourth flow path forming member 140 that is bonded on the third flow path forming member 130 and connected to the recording head 13.

The first flow path forming member 110 has an introduction port 111 that is connected to the ink supply tube 12, and an introduction flow path 112 that penetrates the first flow path forming member 110 from the introduction port 111 to the second flow path forming member 120.

The second flow path forming member 120 is bonded on a surface of the first flow path forming member 110 which is opposite to the introduction port 111. The second flow path forming member 120 has a penetration flow path 121 that communicate with the introduction flow path 112 and penetrates the second flow path forming member 120, and an upstream flow path 122 formed as a channel that is open to a surface of the second flow path forming member 120 on which the third flow path forming member 130 is bonded and extends from one end where the penetration flow path 121 is located to the other end in a plane direction of the second flow path forming member 120.

The third flow path forming member 130 is bonded on a surface of the second flow path forming member 120 to which the upstream flow path 122 is open so as to seal one side of the upstream flow path 122. The third flow path forming member 130 has a filter chamber 131 that communicates with the other end of the upstream flow path 122 which is opposite to the penetration flow path 121 and penetrates the third flow path forming member 130. A filter 150 is disposed at an opening on the downstream side of the filter chamber 131 at a position between the third flow path forming member 130 and the fourth flow path forming member 140. Further, the filter chamber 131 is formed as an expanded width portion that has an inner diameter gradually increasing from the upstream side where the flow path 122 is located toward the downstream side such that the filter 150 has an enlarged surface area that reduces a resistance of ink passing through the filter 150.

The filter 150 disposed on the filter chamber 131 is located at a position vertically below an air bubble trap 123, which is described later. That is, the air bubble trap 123 is located vertically above the filter 150 and is configured such that air bubbles which are blocked by the filter 150 and collected in the filter chamber 131 move upward into the air bubble trap 123 due to the buoyancy of air bubbles themselves.

The fourth flow path forming member 140 is bonded on a surface of the third flow path forming member 130 to which the filter chamber 131 is open. The filter 150 is secured to the fourth flow path forming member 140, for example by welding, at a region that covers the opening of the filter chamber 131 and positioned between the third flow path forming member 130 and the fourth flow path forming member 140. Further, the fourth flow path forming member 140 has a downstream flow path 141 such that one end of the downstream flow path 141 is open at a region opposite the filter chamber 131 and the other end is connected to the recording head 13.

In the above described filter unit 14, a series of flow paths extending from the introduction flow path 112 of the first flow path forming member 110, through the penetration flow path 121 and the upstream flow path 122 of the second flow path forming member 120, the filter chamber 131 of the third flow path forming member 130 to the downstream flow path 141 of the fourth flow path forming member 140 constitutes a distribution flow path 160. When ink is introduced from the ink cartridge 11 via the ink supply tube 12 to the filter unit 14 of the recording head unit 2, ink is supplied from the introduction port 111 via the distribution flow path 160 to the recording head 13.

Figure 3:
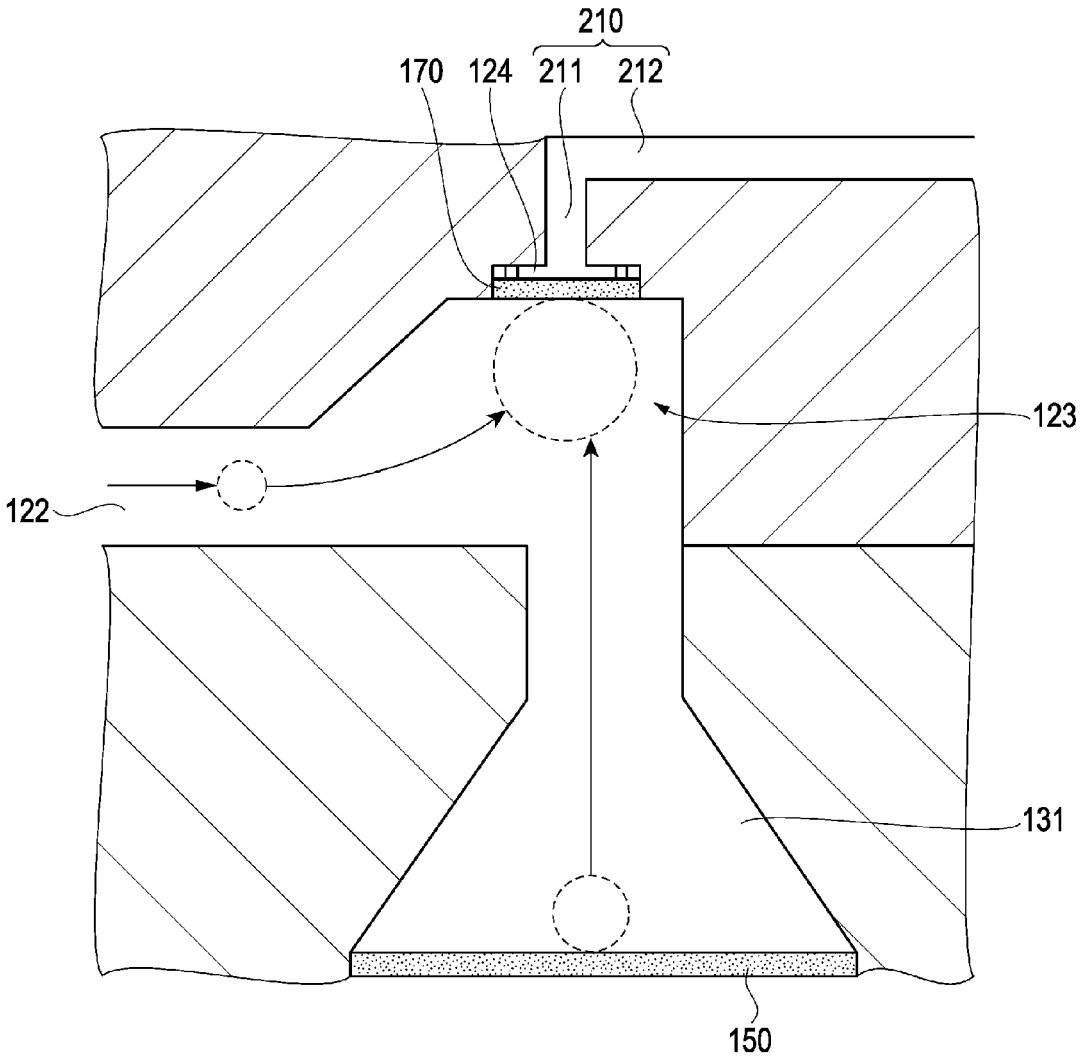
FIG. 3 is an enlarged view of an air bubble trap.

Further, in this embodiment, the air bubble trap 123 is formed in the second flow path forming member 120. FIG. 3 is an enlarged view of an air bubble trap 123. As shown in FIG. 3, the upstream flow path 122 of the second flow path forming member 120 is formed so as to expand vertically upward from the upstream area to the downstream area, and a portion of the upstream flow path 122 which expands vertically upward serves as the air bubble trap 123.

A recess 124 is formed on a vertically upper side of an inner wall of the air bubble trap 123, and a waterproof member 170 fits and is secured in the recess 124, for example by welding. Accordingly, the waterproof member 170 per se forms part of the inner wall of the air bubble trap 123 and one side of the waterproof member 170 is exposed to the inside of the air bubble trap 123. A space is formed between the recess 124 and the waterproof member 170, that is, on the side opposite to the air bubble trap 123 with respect to the waterproof member 170 so as to communicate with a suction path 210 of an air bubble suction mechanism 200.

The waterproof member 170 is made of, for example, a laminated composite of a rolled polytetrafluoroethylene film and polyurethane polymer, and has both a waterproof property that is resistant to liquid permeation and an air permeability that allows a gas such as air to permeate therethough. A specific example of the waterproof member 170 includes Gore-Tex (registered trademark). Further, the waterproof member 170 preferably has a water-repellent finishing on its surface on the side of the air bubble trap 123 so that the waterproof member 170 has an improved waterproof property while maintaining the air permeability.

Moreover, the waterproof member 170 is provided for each of the distribution flow path 160 for cyan ink, the distribution flow path 160 for magenta ink, the distribution flow path 160 for yellow ink, and the distribution flow path 160 for black ink that correspond to four ink cartridges 11. That is, in this embodiment, four waterproof members 170 are disposed in the recording head unit 2.

Figure 4:
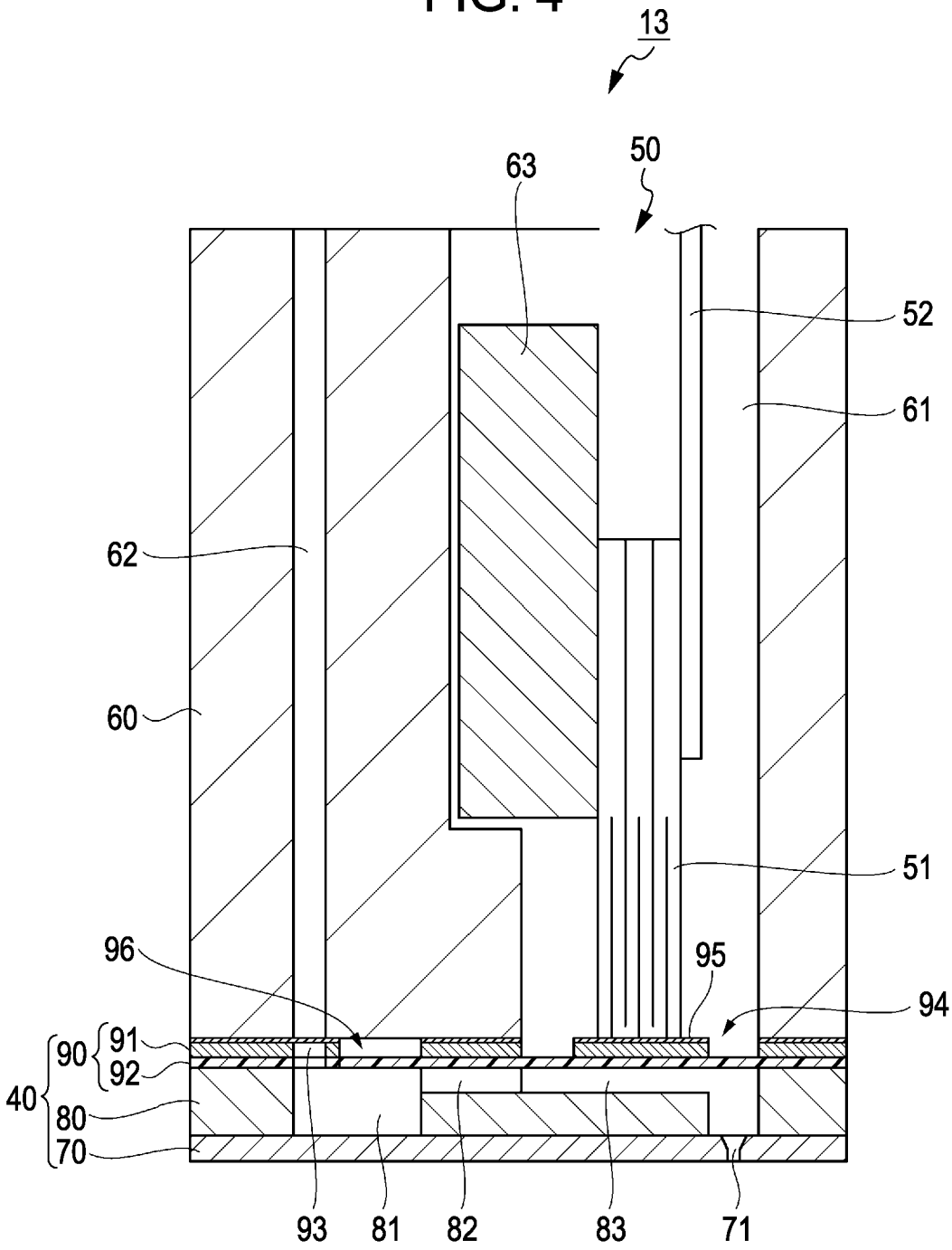
FIG. 4 is a view which shows a configuration of a recording head.

Next, a configuration of the recording head 13 will be described. FIG. 4 is a view which shows a configuration of the recording head 13. As shown in FIG. 4, the recording head 13 includes a flow path unit 40 in which a flow paths such as reservoirs 81, ink supply flow paths 82, pressure generating chambers 83 and nozzles 71 are formed, an transducer unit 50 that generates pressure change to ink in the pressure generating chambers 83, and a head case 60 that houses the transducer unit 50.

The head case 60 is a box-like member having a space for housing the transducer unit 50. One side of the head case 60 is attached to the filter unit 14 and the other side opposite to the filter unit 14 is secured to the flow path unit 40. In the head case 60, a housing space 61 for housing the transducer unit 50, and case flow paths 62 that extend through the head case 60 in a direction from the filter unit 14 to the flow path unit 40 are formed. The case flow path 62 has an upstream end that is connected to the downstream flow path 141 of the filter unit 14 and a downstream end that communicates with the reservoir 81 in a liquid tight manner via an ink introduction port 93 of the flow path unit 40. When ink is supplied from the filter unit 14 to the recording head 13, ink is stored in the reservoirs 81 via the case flow paths 62 of the recording head 13.

The flow path unit 40 includes a nozzles plate 70, a flow path forming substrate 80, and a vibration plate 90. One side of the flow path forming substrate 80 is bonded on the nozzles plate 70, and the other side of the flow path forming substrate 80 which is opposite to the nozzles plate 70 is bonded on the vibration plate 90 for example by using an adhesive, thereby forming a lamination of the nozzles plate 70, the flow path forming substrate 80, and the vibration plate 90.

The nozzles plate 70 is a thin metal plate such as a stainless steel plate and secured to the flow path forming substrate 80, for example by adhering. A plurality of nozzles 71 are formed on the nozzles plate 70 at a predetermined pitch of, for example, 180 dpi in accordance with a dot formation density of the recording head 13. Further, a plurality of nozzles 71 are arranged in rows in the main scan direction so that the rows of nozzles 71 form nozzle arrays.

In the flow path forming substrate 80, a plurality of voids that serve as the pressure generating chambers 83 are formed and are each separated by partitions so as to correspond to the nozzles 71 of the nozzle arrays. In addition, voids that serve as the ink supply flow paths 82 and the reservoirs 81 are also formed. The nozzles plate 70 and the vibration plate 90 are each bonded on the each side of the flow path forming substrate 80 so as to seal an opening of each void, thereby forming a series of flow paths including the reservoirs 81, the ink supply flow paths 82, and the pressure generating chambers 83. Although the flow path forming substrate 80 used in this embodiment is fabricated by etching a silicon wafer, the flow path forming substrate 80 is not limited thereto, and the flow paths may be formed, for example, by laminating a plurality of plate members having through holes that serve as flow paths.

The pressure generating chambers 83 are formed as an elongated chamber extending in a direction perpendicular to the nozzle array direction. The ink supply flow paths 82 are formed as a narrow width portion extending between the pressure generating chambers 83 and the reservoirs 81. The reservoirs 81 are common liquid chamber that are common to a plurality of pressure generating chambers 83 and store ink supplied from the ink cartridges 11. The reservoirs 81 communicate with each of the ink supply flow paths 82 that correspond to the respective pressure generating chambers 83. Accordingly, ink is supplied from the reservoirs 81 via the ink supply flow paths 82 to each of a plurality of pressure generating chambers 83.

The vibration plate 90 is a plate member having a double structure in which a resin film 92 such as PPS (polyphenylene sulfide) is laminated on a metal support plate 91 such as a stainless steel. In the vibration plate 90, a plurality of ink introduction ports 93 that penetrate the vibration plate 90 in the up-down direction are formed at positions corresponding to the respective reservoirs 81 such that the reservoirs 81 and the case flow paths 62 communicate with each other via the ink introduction ports 93.

The vibration plate 90 has a diaphragm 94 at positions corresponding to the pressure generating chambers 83 so as to seal one opening side of the pressure generating chambers 83 and vary the volume of the pressure generating chambers 83. The diaphragm 94 includes islands 95 that are formed by etching the support plate 91 of the plate member having the above described double structure at positions corresponding to the pressure generating chambers 83 and removing portions of the support plate 91 at such positions in an annular shape. The islands 95 are connected to a distal end of the free end of piezoelectric transducers 51, which will be described later. The area of the island 95 is smaller than the area of the corresponding pressure generating chamber 83. Accordingly, a portion of the resin film 92 which corresponds to positions around the island 95 where the support plate 91 is removed by etching, that is, a portion of the resin film 92 in the area corresponding to the pressure generating chambers 83 and where islands 95 are not formed serves as an elastic film.

Moreover, a portion of the support plate 91 of the vibration plate 90 which corresponds to the reservoir 81 is removed by etching while conforming to the opening shape of the void which is formed in the flow path forming substrate 80 and serves as the reservoir 81. Accordingly, the remaining portion of the resin film 92 serves as a compliance section 96. The compliance section 96 seals one opening side of the void which serves as the reservoir 81, thereby providing compliance to ink in the reservoir 81.

Next, a configuration of the transducer unit 50 will be described. The transducer unit 50 includes piezoelectric transducers 51 that correspond to a pressure generating unit, and a flexible cable 52. The piezoelectric transducers 51 are formed in a comb teeth-like shape, each of the elongated comb teeth having an extremely narrow width in the order of tens of μm. The piezoelectric transducers 51 are formed as a vertical vibration type that is capable of expanding and contracting in the vertical direction. The piezoelectric transducers 51 are bonded on the fixation plate 63 in a so-called cantilever manner with its fixed end being bonded on the fixation plate 63 and its free end projecting from the edge of the fixation plate 63. The distal end of the free end of the respective piezoelectric transducers 51 is secured to the island 95 that constitutes the diaphragm 94 of the flow path unit 40. Further, the fixation plate 63 that supports the respective piezoelectric transducers 51 is formed of a metal plate member having a rigidity capable of receiving a reactive force from the piezoelectric transducers 51. The fixation plate 63 is formed of, for example, a stainless steel having a thickness of approximately 1 mm. Further, one end of the flexible cable 52 is electrically connected to a side of the piezoelectric transducers 51 which is opposite to the fixation plate 63, while the other end is connected to a control board on which a head driving circuit (not shown) is mounted. Accordingly, signals from the print controller are transmitted to the piezoelectric transducers 51 via the control board, the flexible cable 52, thereby controlling expansion and contraction of the piezoelectric transducers 51.

In the recording head unit 2 having the above configuration, since the distal end face of the piezoelectric transducers 51 is bonded on the islands 95, when the piezoelectric transducers 51 are driven by the head driving circuit so as to expand and contract the free end of the piezoelectric transducers 51, the volume of the pressure generating chambers 83 varies to apply pressure change to ink in the pressure generating chambers 83. By using this pressure change, the recording head unit 2 ejects ink from the pressure generating chambers 83 through the nozzles 71 so that ink droplets are ejected onto the landing target such as a recording paper.

In the above described recording head unit 2, air bubbles which have entered ink in the distribution flow path 160 (as shown by the broken line of FIG. 3), for example during mounting and/or removing of the ink cartridge, move into the air bubble trap 123 which forms vertically upper portion of the distribution flow path 160 due to the buoyancy of air bubbles themselves. Further, air bubbles which are blocked by the filter 150 and collected in the filter chamber 131 move into the air bubble trap 123 located vertically above the filter 150 due to the buoyancy of air bubbles themselves. In the printer 1 of this embodiment, an air bubble suction mechanism (suction unit) 200 is disposed so as to discharge air bubbles collected in the air bubble trap 123. The air bubble suction mechanism 200 will be described below.

Figure 5:
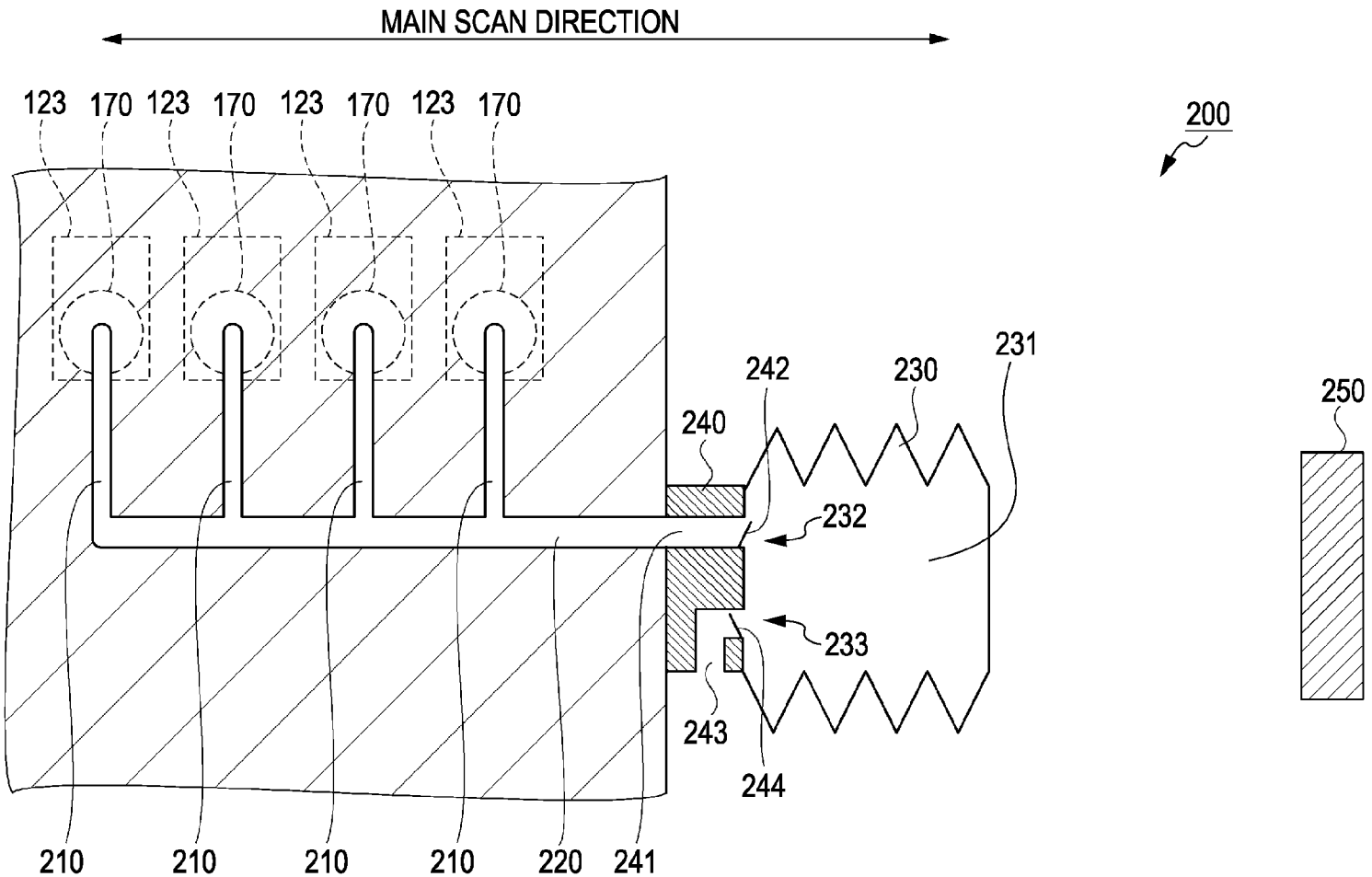
FIG. 5 is a view which shows a configuration of an air bubble suction mechanism.

FIG. 5 is a view which shows a configuration of an air bubble suction mechanism 200. As shown in FIG. 5, the air bubble suction mechanism 200 includes four suction paths 210 that corresponds to the four waterproof members 170, a merge path 220 that merges the four suction paths 210, a bellows-shaped pump member 230, a holding member 240 that holds the pump member 230 on the recording head unit 2, and an abut member 250 disposed on the main body of the printer 1. Further, one of the four suction paths 210 is a first suction path, and another suction path 210 is a second suction path.

In the air bubble suction mechanism 200, the suction paths 210 and the merge path 220 are formed in the filter unit 14. As shown in FIG. 3, the suction path 210 communicates with a space formed by the recess 124 of the air bubble trap 123, which is on the side opposite to the air bubble trap 123 with respect to the waterproof member 170. The second flow path forming member 120 has a first path 211 that extends from the recess 124 of the air bubble trap 123 in the vertically up direction, and a second path 212 formed as a channel that extends from one end of the first path 211 in the plane direction of the second flow path forming member 120. The first flow path forming member 110 is bonded on a surface of the second flow path forming member 120 to which the second path 212 is open so as to seal the upper opening of the second path 212 which is formed as a channel, thereby forming a series of suction path 210 in which the first path 211 and the second path 212 communicate with each other. As shown in FIG. 5, the four suction paths 210 are formed in the filter unit 14 corresponding to the four waterproof members 170 disposed in the recording head unit 2.

The merge path 220 is a flow path formed as a channel, similar to the second path 212, on a surface of the second flow path forming member 120 which is on the side of the first flow path forming member 110. The upper opening of the merge path 220 formed as a channel is closed by the first flow path forming member 110. Further, the merge path 220 extends in the main scan direction and communicates with each end of the four suction paths 210. That is, the four suction paths 210 merge into the merge path 220. The end of the merge path 220 which is opposite to the suction paths 210 is open to the outside of the filter unit 14.

The pump member 230 is, for example, a bellows pump and is capable of expanding and contracting so that the volume of a pump chamber 231 that is formed in the pump member 230 changes as the pump member 230 expands and contracts. The pump member 230 is provided with an inlet port 232 through which air flows into the pump chamber 231 and an outlet port 233 through which air flows out from the pump chamber 231.

The holding member 240 is a member for holding the pump member 230 on the recording head unit 2. The holding member 240 can be of any configuration as long as holding the pump member 230 so that the pump member 230 moves with the recording head unit 2 during scanning of the carriage 3. As shown in FIG. 5, the pump member 230 may be mounted on the recording head unit 2 itself, or alternatively, may be mounted on the carriage 3.

An inlet path 241 and an atmosphere opening path 243 are formed in the holding member 240. The inlet path 241 connects the merge path 220 of the filter unit 14 to the pump chamber 231 of the pump member 230, and has one end which is open to the end of the merge path 220 and the other end which communicates with the inlet port 232 of the pump member 230. Further, the inlet path 241 is provided with a first check valve 242 that controls a flow out of the pump chamber 231 of the pump member 230 into the merge path 220.

An atmosphere opening path 243 is a path for discharging air inside the pump chamber 231 to the outside, and has one end which communicates with the outlet port 233 of the pump member 230 and the other end which is open to the atmosphere. The atmosphere opening path 243 is provided with a second check valve 244 that controls an air flow into the pump chamber 231 of the pump member 230 via the atmosphere opening path 243.

The abut member 250 is a plate member for expanding and contracting the bellows-shaped pump member 230 and is disposed on the main body of the printer 1. The abut member 250 is positioned at the end of the main scan direction so that the pump member 230 abuts against the abut member 250 at a predetermined position in the main scan direction when the pump member 230 moves with the recording head unit 2 by scanning of the carriage 3.

Figure 6A:
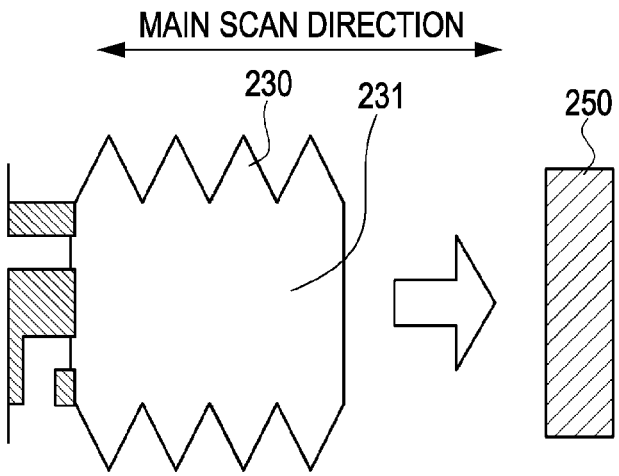
FIGS. 6A to 6C are explanatory views of an air bubble suction operation.
Figure 6B:
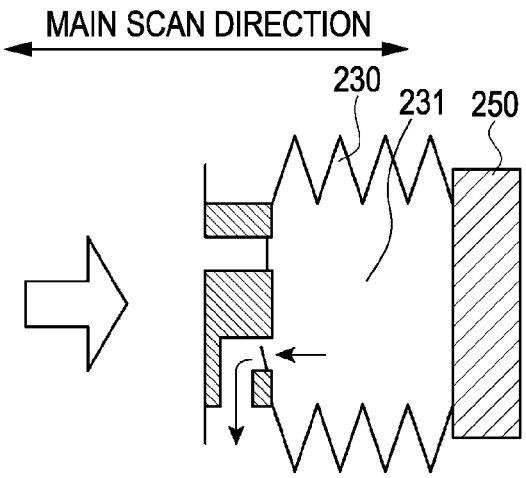
Figure 6C:
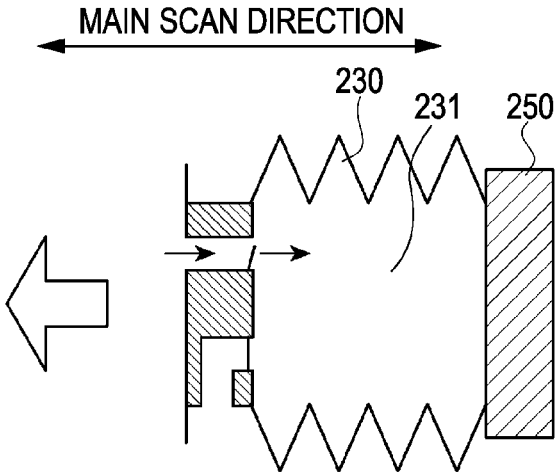

Air bubble suction operation of the above described printer 1 will be described below. FIGS. 6A to 6C are explanatory views of the pump member 230 during air bubble suction operation. When performing air bubble suction operation, the carriage moving mechanism 4 moves the carriage 3 toward the abut member 250 as shown in FIG. 6A, so that the pump member 230 abuts against the abut member 250.

Then, the carriage moving mechanism 4 reciprocates the pump member 230 while the pump member 230 mounted on the recording head unit 2 is in contact with the abut member 250. As shown in FIG. 6B, the carriage moving mechanism 4 forces the pump member 230 mounted on the recording head unit 2 to abut against the abut member 250, and further moves the pump member 230 toward the end side. Accordingly, the pump member 230 is compressed and contracted by the abut member 250 to apply a pressure to the inside of the pump chamber 231. At this time, the first check valve 242 closes so as to close the inlet path 241, while the second check valve 244 opens so as to discharge the pressurized air in the pump chamber 231 to the outside through the atmosphere opening path 243. As a result, the pressure inside the pump chamber 231 becomes substantially equal to that of the atmosphere.

As shown in FIG. 6C, the carriage moving mechanism 4 then moves the pump member 230 in a direction away from the abut member 250 while the pump member 230 is in contact with the abut member 250. Accordingly, since the pump member 230 expands from the state shown in FIG. 6B, the pump chamber 231 is depressurized and the pressure inside the pump chamber 231 becomes negative. At this time, the first check valve 242 opens thereby allowing the pump chamber 231 to communicate with the merge path 220 via the inlet path 241, while the second check valve 244 closes, thereby enabling the pump member 230 to effectively suction through the four suction paths 210, the inlet path 241 and the merge path 220. Accordingly, a gas which generates air bubbles in the air bubble trap 123 flows through the waterproof member 170 having an air permeability and via the suction paths 210, the merge path 220, and the inlet path 241 into the pump chamber 231 of the pump member 230 so that air bubbles in the air bubble trap 123 become small or disappear. On the other hand, ink in the air bubble trap 123 does not flows via the suction path 210 into the pump member 230, since ink does not tend to pass through the waterproof member 170 having a waterproof property.

As described above, in this embodiment, air bubbles in the distribution flow path 160 of the recording head unit 2 are discharged from the distribution flow path 160 through the waterproof member 170 having an air permeability by applying suction from the pump member 230, while preventing ink in the distribution flow path 160 from being discharged with air bubbles, since ink does not tend to pass through the waterproof member 170 having a waterproof property. Therefore, it is possible to discharge air bubbles from the flow paths in the recording head unit 2 while reducing consumption of ink.

Further, since the vertically upper portion of the upstream flow path 122 serves as the air bubble trap 123, air bubbles which have entered the upstream flow path 122 move into the air bubble trap 123 due to the buoyancy of air bubbles themselves. Moreover, since the filter 150 is disposed vertically below the air bubble trap 123, air bubbles which have entered the distribution flow path 160 and are then blocked by the filter 150 and collected in the filter chamber 131 move into the air bubble trap 123 by rising due to the buoyancy. As described above, air bubbles stored in the air bubble trap 123 are suctioned by the air bubble suction mechanism 200, therefore it is possible to effectively discharge air bubbles which have entered ink in the distribution flow path 160.

Further, since four suction paths 210 merge into the merge path 220 so that air bubbles in a plurality of air bubble traps 123 are suctioned via the merge path 220 by using a single pump member 230, a simplified configuration of the air bubble suction mechanism 200 is possible compared with the case where the pump members 230 are provided for each of the suction paths 210. The air bubble suction mechanism 200 achieves suctioning of air bubbles with a simple configuration using the bellows pump and the check valves by making use of carriage scan of the recording head unit 2. Therefore, it is possible to achieve the recording head unit 2 with a low cost that is capable of discharging air bubbles from the flow paths in the recording head unit 2 while reducing consumption of ink.

One embodiment of the invention has been described above, however the invention is not limited thereto, and may have various embodiments by modifications or alterations without departing from the spirit of the invention and scope of the claims. It is needless to say that the invention includes the equivalents thereof. The following will describe modified examples of the invention.

First Modified Example

Figure 7:
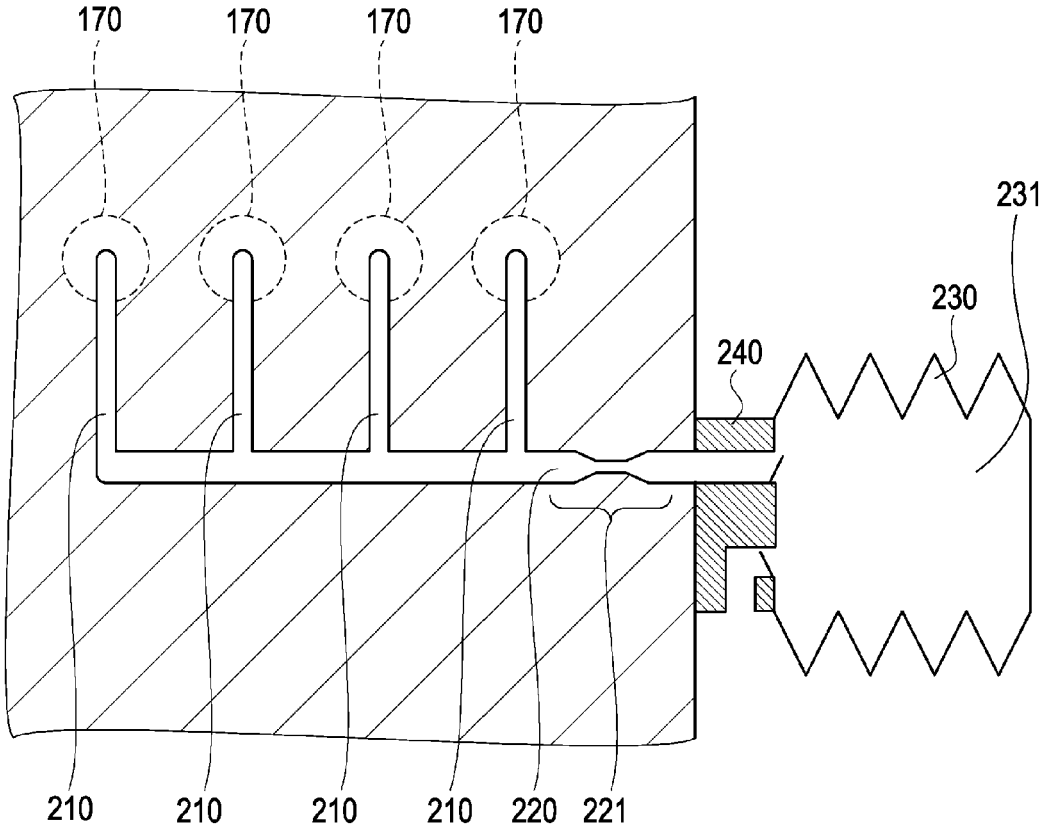
FIG. 7 is an explanatory view of a first modified example.

Although in the above embodiment, a flow path sectional area of the merge path 220 is constant, a narrowed portion 221 having a reduced flow path sectional area may be disposed in the merge path 220 as shown in FIG. 7. With this configuration, since the narrowed portion 221 serves as a flow path resistance, it is possible to prevent ink thickening due to volatilization of ink in the air bubble trap 123 via the waterproof member 170, the first path 211, the merge path 220, the second path 212, the pump member 230, and the atmosphere opening path 243. Further, since the narrowed portion 221 serves as a flow path resistance, suctioning of air bubbles is gradually performed over a longer period of time with the same amount of expansion and contraction of the pump member 230. Accordingly, air bubbles can be more effectively suctioned by adjusting the amount and duration of suction force to suction air bubbles by appropriately designing the form of the narrowed portion 221.

Second Modified Example

Although in the above embodiment, one waterproof member 170 is provided for each of the four air bubble traps 123, a plurality of waterproof members 170 may be provided for each air bubble trap 123. For example, in the case where air bubbles tend to be collected at the corners of chamber that forms the air bubble trap 123, the waterproof members 170 may be provided for each corner of the air bubble trap 123. With this configuration, air bubbles collected in the air bubble trap 123 can be more effectively discharged.

Third Modified Example

Figure 8A:
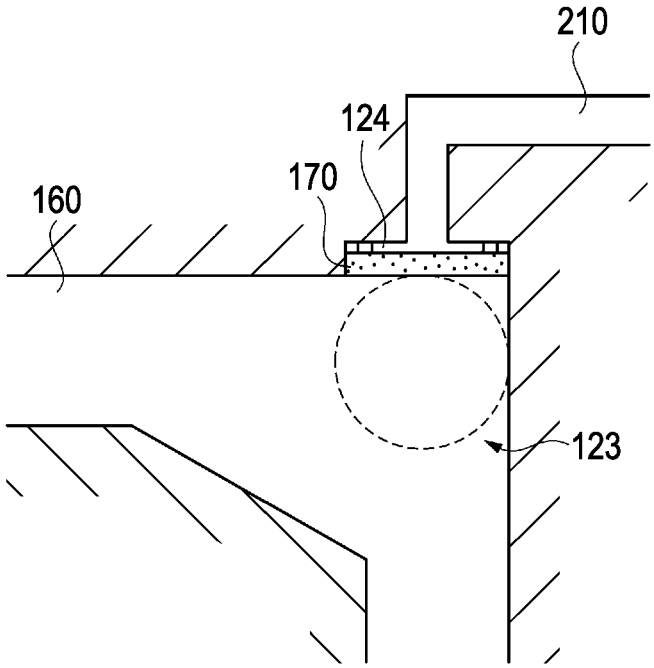
FIGS. 8A and 8B are explanatory views of a third modified example.
Figure 8B:
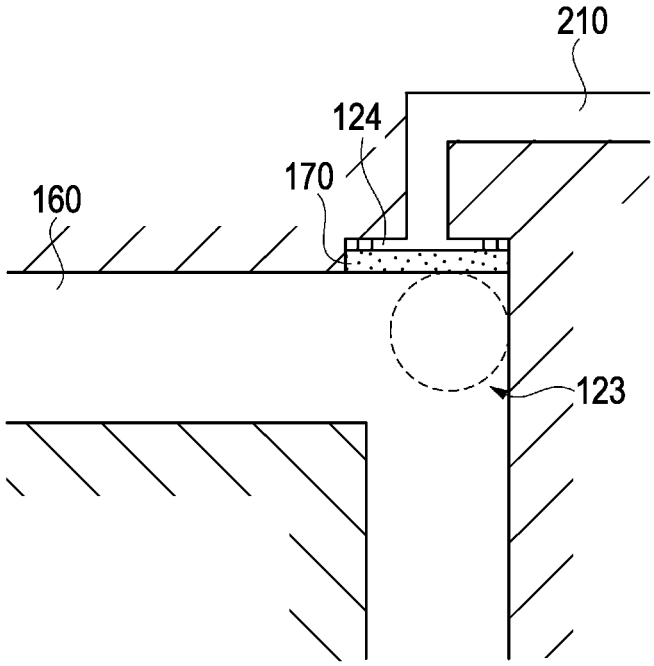

Although in the above embodiment, a portion of the distribution flow path 160 which expands vertically upward serves as the air bubble trap 123, the configuration of the air bubble trap 123 is not limited thereto. For example, as shown in FIG. 8A, an upper side of a portion of the distribution flow path 160 which expands vertically downward may serve as the air bubble trap 123. Further, an expanded portion may not be provided, and in the case where distribution flow path 160 has no expanded portion, the outer corner of the bend of the flow path in which air bubbles tend to be collected may serve as the air bubble trap 123 as shown in FIG. 8B.

Fourth Modified Example

In the above embodiment, since the pump member 230 is opened to the atmosphere via the atmosphere opening path 243, if a slight amount of ink in the air bubble trap 123 enters the suction path through a gap between the waterproof member 170 and the flow path, or passes through the waterproof member 170, it could be possible that a slight amount of ink flows into the pump chamber 231, and then leaks out via the atmosphere opening path 243. In that case, an ink absorbing member made of a porous material may be provided at an end of the atmosphere opening path 243 which is opposite to the pump member 230 so that a slight amount of ink leaked out from the atmosphere opening path 243 is absorbed by the ink absorbing member.

Fifth Modified Example

Although in the above embodiment, air bubbles collected in the air bubble trap 123 are discharged through suctioning of the bellows pump by using movement of the carriage 3, the technique to suction air bubbles is not limited thereto. For example, the abut member 250 may be configured to move relative to the pump member 230 mounted on the carriage 3 or the recording head unit 2 so as to expand and contract the pump member 230. Alternatively, suctioning may be performed by an electric pump without using movement of the carriage 3.

Sixth Modified Example

Although in the above embodiment, the liquid ejection head has been described by way of example of the recording head that ejects ink using piezoelectric elements of a so-called longitudinal vibration type, the liquid ejection head is not limited thereto. For example, a liquid ejection head using piezoelectric elements of flexural mode or a liquid ejection head using a share mode may be used. Further, a liquid ejection head that generates pressure change of a liquid in the pressure generating chambers by using heat from heat generating elements, or a liquid ejection head that generates pressure change of a liquid in the pressure generating chambers by using a static actuator. In addition, a line type liquid ejection head may also be used.

Seventh Modified Example

Although in the above embodiment, the liquid ejection head has been described by way of example of the recording head that ejects ink and the liquid ejection apparatus has been described by way of example of the printer, a liquid ejection head that ejects a liquid other than ink and a liquid ejection apparatus having such a liquid ejection head may be used. The liquid to be ejected may include, for example, a solution of each color material used for color filters of liquid crystal displays, a solution of organic electro luminescence (EL) material used for organic EL displays, and a liquid electrode material used for forming electrodes for field emission displays (FEDs). The liquid ejection heads that eject such a liquid may include, for example, color material ejecting heads used for manufacturing color filters for liquid crystal displays, electrode material ejecting heads used for forming electrodes for FEDs, and bioorganic ejecting heads used for manufacturing biochips.

The entire disclosure of Japanese Patent Application No. 2011-193597, filed Sep. 6, 2011 is incorporated by reference herein.

What is claimed is:

1. A liquid ejection apparatus comprising:

a liquid ejection head that ejects a liquid;

a flow path forming member having a distribution flow path through which the introduced liquid flows into the liquid ejection head, the flow path forming member including an air bubble trap in which air bubbles which have entered the liquid in the distribution flow path are collected, and a waterproof member having a waterproof property and an air permeability that forms part of a wall of the air bubble trap, wherein the air bubble trap is included in the distribution flow path such that liquid flowing to the ejection head passes through the air bubble trap; and a suction unit that suctions air bubbles in the air bubble trap through the waterproof member.

2. The liquid ejection apparatus according to claim 1, wherein the distribution flow path has an expanded flow path that expands in the vertical direction, and a vertically upper portion of the expanded flow path serves as the air bubble trap.

3. The liquid ejection apparatus according to claim 2, further comprising a filter that is disposed in the distribution flow path of the flow path forming member, wherein the air bubble trap is located vertically above the filter.

4. The liquid ejection apparatus according to claim 2, wherein the flow path forming member further includes a second air bubble trap in which air bubbles which have entered the introduced liquid are collected, and a second waterproof member having a waterproof property and an air permeability that forms part of a wall of the second air bubble trap, and wherein the suction unit includes a first suction path that extends on a side of the waterproof member which is opposite to the air bubble trap, a second suction path that extends on a side of the second waterproof member which is opposite to the second air bubble trap, a merge path that merges the first suction path and the second suction path, and a pump member that suctions air bubbles via the merge path.

5. The liquid ejection apparatus according to claim 1, further comprising a moving mechanism that moves the liquid ejection head, wherein the suction unit includes a pump member that is configured to expand and contract so as to suction air bubbles through the waterproof member, and an abut member that is disposed at a position capable of abutting against the pump member when the liquid ejection head moves, and wherein the moving mechanism moves the pump member with the liquid ejection head in directions away from and toward the abut member so as to expand and contract the pump member.

6. The liquid ejection apparatus according to claim 5, wherein the suction unit includes an inlet path that connects a side of the waterproof member which is opposite to the air bubble trap and an inside of the pump member, an atmosphere opening path that opens the inside of the pump member to the atmosphere, a first check valve that controls a flow out of the pump member via the inlet path, and a second check valve that controls a flow into the pump member via the atmosphere opening path.

7. The liquid ejection apparatus according to claim 1, wherein the air bubble trap is provided in a vertically upper portion of the distribution flow path.

* * * * *